United States Patent [19]

Bradshaw

[11] 4,150,370

[45] Apr. 17, 1979

[54] SMOKE DETECTOR

[76] Inventor: Thurman Bradshaw, 619 S. Washington, Liberal, Kans. 67901

[21] Appl. No.: 826,413

[22] Filed: Aug. 22, 1977

[51] Int. Cl.[2] ..... G08B 17/10; G08B 26/00

[52] U.S. Cl. ..... 340/518; 340/628; 340/634

[58] Field of Search ..... 340/237 R, 413, 628, 340/630, 632, 633, 634, 517, 518

[56] References Cited

U.S. PATENT DOCUMENTS

| | | | |
|---|---|---|---|
| 2,533,339 | 12/1950 | Willenborg | 340/237 R |
| 3,906,473 | 9/1975 | Le Vine | 340/237 R |
| 3,909,816 | 9/1975 | Teeters | 340/237 R |
| 3,983,554 | 9/1976 | Goode | 340/413 |
| 3,997,837 | 12/1976 | Betz et al. | 340/237 R X |

*Primary Examiner*—John W. Caldwell, Sr.
*Assistant Examiner*—Daniel Myer
*Attorney, Agent, or Firm*—Head, Johnson & Chafin

[57] ABSTRACT

A detector for smoke and/or selected gases includes a sensor means to which the smoke or gas is applied. The sensor is connected at one terminal to ground, the other terminal going through a current meter, through a control potentiometer to a selected positive DC voltage. A potential detector is connected at a selected point in the potentiometer so as to determine when a selected magnitude of current is flowing through the sensor. The output of the detector goes through an alarm control means, and an alarm, which is sounded whenever the current through the sensor is greater than a selected minimum value. The system also includes a scanning detector system where a plurality of separate sensors are used, each in a separate location. A control system rapidly switches a detector from one sensor to another, measuring the current through each sensor, and when this current is greater than the selected minimum, the scanning control stops for a selected short period such as five seconds, or so, and displays the meter, showing the current through the detector, and displays a number, corresponding to that of the sensor, that is connected to the detector at that particular moment.

7 Claims, 3 Drawing Figures

SMOKE DETECTOR

BACKGROUND OF THE INVENTION

1. Field of the Invention

This invention lies in the field of gas and smoke detectors.

More particularly it is concerned with a system which includes a sensor of a selected type, which is sensitive to a number of selected gases and to smoke. More particularly the detector system utilizes a plurality of sensors, in separate locations, and includes an electronic scanning means for selectively connecting each of the plurality of sensors to a single detector and meter, and stepping the detector sequentially to each of the sensors. Whenever the detector shows a value of meter current, or sensor current greater than the selected minimum, the stepping is stopped, so that the current, and a number can be displayed. The number corresponds to the particular sensor which is then connected to the detector. After a selected short period of time, the scanning means proceeds to contact each of the other sensors, and it will stop at each sensor that shows a greater than minimum sensor current.

2. Description of the Prior Art

In the prior art, there are many different types of sensors and sensor circuits illustrated.

All of the prior art sensors show a circuit which is adapted generally to a single sensor. If a plurality of such sensors are utilized, they include a separate control and display for each sensor, making for a very complex circuit, if there are a substantial number of sensors. Or they may connect all sensors in parallel to a single detector, which does not indicate which sensor is above threshold.

This invention is directed to a system for having a multiplicity of sensors, each of them in a separate location and measuring system, plus a scanning control which continuously scans the whole series of detectors looking for one that indicates a sensor current larger than a selected minimum value. When it finds such a sensor, scanning is stopped and the magnitude of sensor current is displayed, along with a number corresponding to that particular sensor and an alarm is sounded.

SUMMARY OF THE INVENTION

It is a primary object of this invention to provide a system for control of a large plurality of sensors of a type which provide a current which is a function of the concentration of a selected gas or smoke. Thus when a selected gas has a concentration greater than a selected minimum value, the current through the sensor, which increases with the concentration, becomes larger than a minimum value, and an alarm is sounded.

It is a further object of this invention to provide a system including a plurality of solid state sensors, sensitive to selective gases and smoke, such that each of the plurality of sensors are sequentially scanned by a single detection system, so that a single detector and display can be used to monitor the large number of separate sensors.

These and other objects are realized and the limitations of the prior art are overcome in this invention, by providing at least one sensor means. One such sensor which is available on the market and can be used for detecting and quantifying the percentage of such a gas in air is a solid state sensor known as the Figaro TG-5 gas sensor, and can be obtained from Figaro Engineering Inc., 3303 Harbor Blvd., Suite D-8, Costa Mesa, Calif. 92626. This sensor includes a heater which is required to maintain a substantially constant temperature in the sensor.

A low voltage DC power supply is provided and is connected through suitable resistor means to the heater. The sensor is connected with one terminal at ground, the other terminal connected through a current meter, and through suitable resistors to the DC voltage. The potential at a selected point in the resistors is connected to a voltage detector such that when the potential at the input to the detector reaches a value corresponding to a selected minimum value of current in the sensor, a switch connects power to a suitable alarm. The alarm control means may include an oscillator to turn the alarm signal on and off at a selected frequency. It also includes amplifier means to power the alarm.

In a preferred form of this invention a plurality of sensors are utilized; each one installed in a separate locality, such as in a separate room of a motel or hotel, etc. There is an electronic switching means which connects a single detector system sequentially to each of the sensors. This scanning of the sensors is done quite rapidly (such as 200 per second, for example) so that there is almost constant attention to each of the sensors, in each of the localities. However, if at any moment the detector is connected to a sensor which shows a current greater than the selected minimum, it will stop the scanning, and display a number corresponding to the particular sensor to which the scanner is connected, and will sound an alarm.

A flip-flop oscillator circuit responsive to the output of the detector puts out square waves of potential at a selected frequency. At each of these square waves, a counter is advanced and also a switching system, including flip-flops continually switched on selective sequential sensors, which are connected through a single detector. So long as the current through the sensors is less than the minimum, the oscillator continues the switching. When the switching reaches the last or Nth sensor, the system is reset and it starts again with the first sensor and continues to scan through the entire number.

Whenever a sensor is connected to the detector, and for which the current is higher than the threshold, the oscillator stops and the particular sensor that is then connected to the detector remains in contact so that the meter display will show its current. At the same time the counter, which has been updated with each switching to a sequential sensor, indicates the serial number of the sensor, and this number is displayed. Thus, it can be determined that a particular sensor is showing a threshold current greater than the selected minimum.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
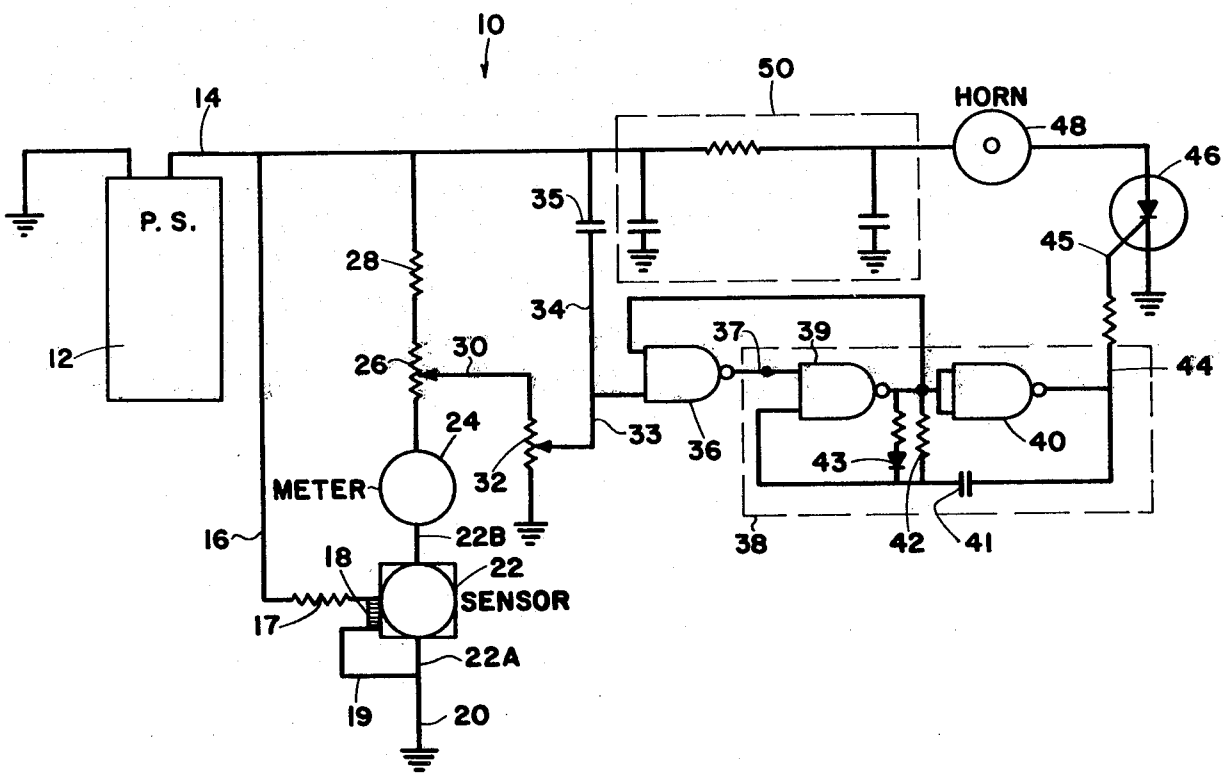
FIG. 1 illustrates schematically the circuit of one embodiment of this invention which includes a single sensor.

Referring now to the drawings and in particular to FIG. 1, there is shown one embodiment of this invention. It is a detector system for using a gas detector of a selected type, to indicate through a meter, a current which is responsive to the concentration of a selected gas, or smoke, in the air, in the vicinity of the sensor.

While this apparatus can be used with a number of different sensors in which a current through the sensor is a function of the concentration of that selected gas, it operates very well with a particular kind of solid state sensor (previously described) which is indicated by numeral 22 in FIG. 1. A heater is required and is part of the sensor 22 to maintain a substantially constant temperature in the sensor. This heater is supplied with current from the power supply 12 through leads 14, 16 and 19, with control resistor 17. Other sensors may not require this heater connection. The current return to the power supply is through ground 20.

The sensor 22 has one lead 22A connected to ground 20, which helps to minimize noise in the sensor circuit. Noise is picked up as positive going spikes on the input to the gate 36, which is already saturated in the positive direction. Detection signals from the sensor are in the negative direction, and are therefore not affected by the noise spikes. The second terminal 22B is connected through meter 24, through potentiometer 26, and resistor 28, to lead 14, which represents a selected positive voltage DC, which may be different for different sensors, but can be of the order of six volts. With the series connection of resistors 28 and 26 and the sensor 22, the potential on lead 30 connected at a point on the potentiometer 28, will be a measure of the current flowing in the sensor. The lower the current the higher the potential on lead 30, and vice versa. The lead 30 is connected through another potentiometer 32 to ground, so that a lead 33 connected to the second potentiometer 32 provides a fine control on the potential which is supplied by lead 33 to the gate 36.

When there is no current through the sensor the potential of the lead 33 going to terminal 2 of the NAND gate 36 is high. The potential on lead 1 is also high, so that the output on lead 37, is low, going to an alarm control circuit enclosed in the dashed outline 38. However, when the current increases in the sensor, the potential on the number 2 terminal of the gate 36 drops, and when it drops to a selected point the potential on lead 37 on its output goes high, and causes the control circuit 38, which is a flip-flop system including two gates 39 and 40, with various other elements, which are well known in the art, to operate. Applying high potential to the gate 39 causes an oscillation of the control circuit 38 and provides a potential on the output lead 44, which is a square wave, providing a high/low/high, etc. sequence of potential. The output on lead 44 goes to the control lead 45 on an SCR device 46, which is connected in series with an alarm, such as a horn, or buzzer, 48 or a light, to the DC bus 14. Thus the alarm is sounded in accordance with the sequence of the square wave from the control 38. A filter 50 may be provided in the DC bus 14, as desired, but may not be necessary.

What has been described so far is a single sensor gas detector system which includes a sensor sensitive to a selected gas, and provided with a DC potential through a resistance network and through a meter. A detector system is connected to the resistor network to monitor a potential which is a function of the current through the sensor. When the detector shows a potential less than the threshold, it turns on an oscillator and an amplifer to sound an alarm.

Figure 2:
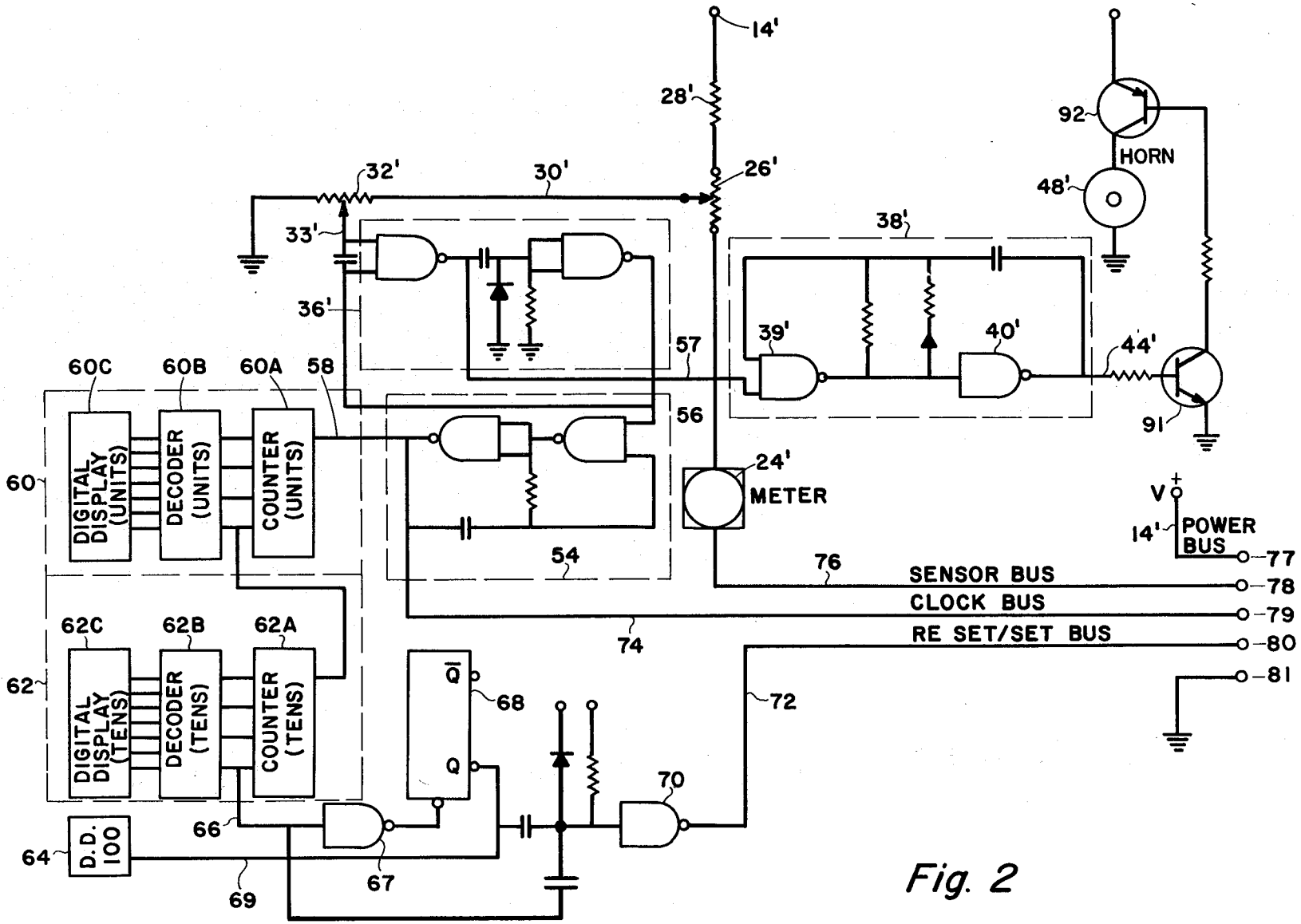
FIGS. 2 and 3 illustrate together a preferred embodiment of the invention which includes a plurality of sensors which may be located in different locations and which are by means of a scanning system, connected in series with a detection system which is outlined in FIG. 2.
Figure 3:
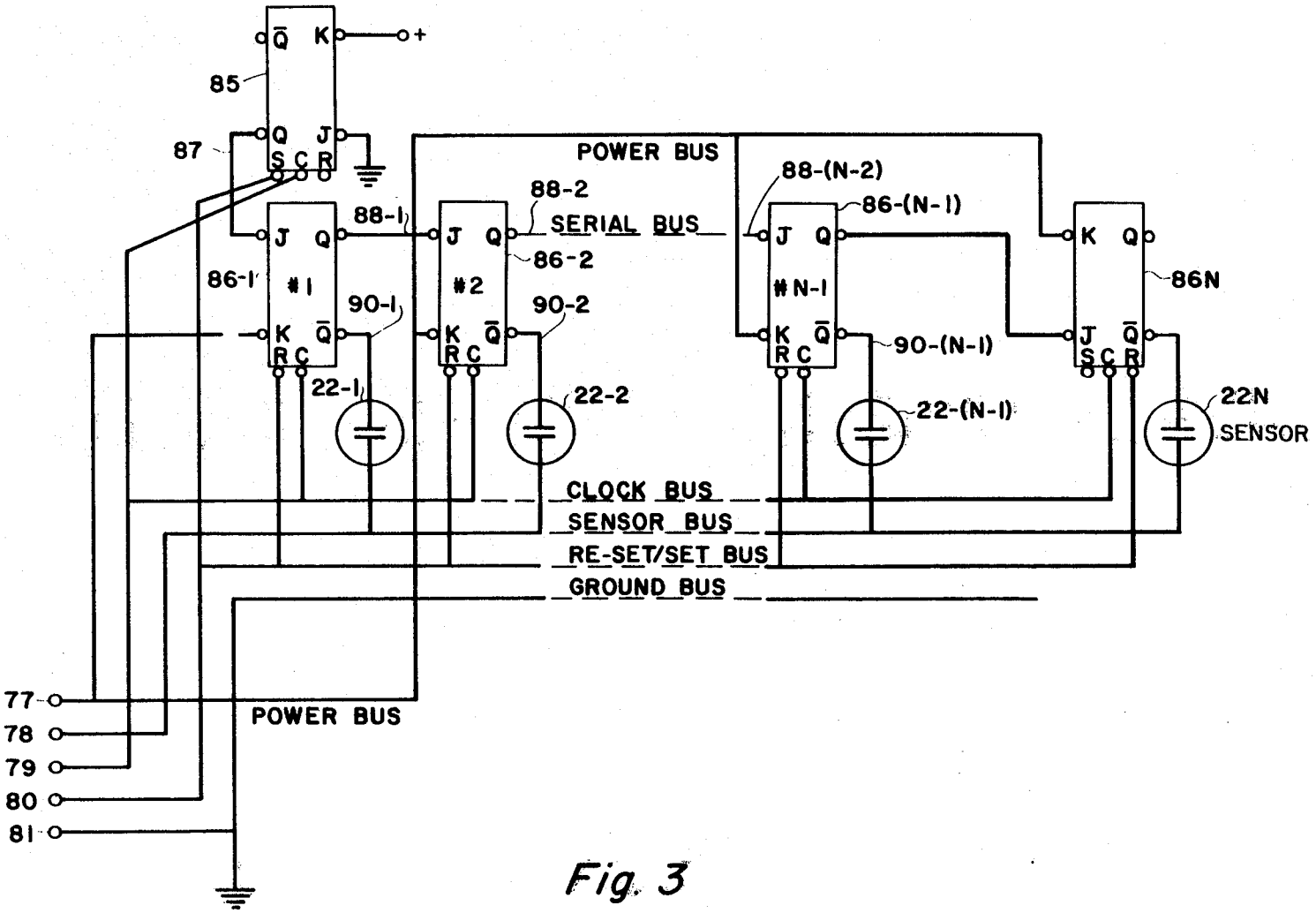

Referring now to FIGS. 2 and 3 there are shown portions of an improved preferred circuit for a plurality of sensors, of the type 22, shown in FIG. 1. The object of this circuit is to provide a large plurality of sensors, with a single meter, and a single detector, and a single alarm, and to scan through the plurality of sensors so that they are sequentially and numerically connected, in turn, to the detector. The detector includes a clock or oscillator which steps the switching circuits from one to the next in the series of sensors. Whenever a sensor becomes connected to the detector, which shows a smaller than threshold value of potential, or a greater than theshold current in the sensor, the clock stops, the scanning stops, and a number is displayed which corresponds to that particular sensor which is then connected to the detector.

Referring now to FIG. 2, there is a meter 24' which is similar to the meter 24 of FIG. 1, which is connected to a DC potential indicated as 14', through resistors 28' and 26' corresponding to those of FIG. 1. The potentiometer 26' is connected through lead 30', through potentiometer 32' to ground, and the contact of the potentiometer 32' is connected by lead 33' to a detector circuit indicated within the dashed outline 36'. All of this is so far similar to FIG. 1.

Also shown in a dashed outline, identified by the numeral 38' is an alarm control similar to that shown in the outline 38 of FIG. 1. This circuit has two gates 39' and 40', which operate in the manner similar to those in the box 38 of FIG. 1. The output of the box 38' goes by lead 44' to an amplifier, including transistors 91 and 92, which provide an amplified current to the alarm, which may be a horn or buzzer 48', similar to FIG. 1. Thus when the detector finds an anomalously high current in a sensor, it causes the oscillator 38' to oscillate, and its output to be amplified and to control the alarm 48. So far only a single detector, single meter, single alarm control, and a single alarm have been indicated.

Referring now to FIG. 3, there is shown in schematic form a series of sensors 22-1, 22-2 . . . 22 (N-1) and 22N. Each of these are connected in a similar manner to a separate flip-flop 86, which are indicated by the numerals 86-1, 86-2 . . . , 86 (N-1), 86N.

These flip-flops numbers 1, 2 . . . N-2, N-1 and N are connected in series from their Q outputs to the J input of the succeeding flip-flop, by leads indicated by numerals 88-1, 88-2, 88 (N-2), etc.

A single flip-flop 85 is provided, one terminal of which is connected to a potential, which provides the starting potential on lead 87 which goes to the first flip-flop's J terminal, and switches the Q terminal to a low value. This connects one terminal of the sensor 22-1 to ground. The other terminal of the sensor 22-1 goes to a bus 78 called the sensor bus, which is connected to terminal 78 of FIG. 3 and is the same as terminal 78 shown in FIG. 2. Terminal 78 of FIG. 2 goes by lead 76 to the meter 24', through resistors 26', 28' to the power supply voltage 14'. Thus when the flip-flop 86-1 is switched the sensor 22-1 is connected to ground through the flip-flop. The other end is connected to the lead 76, through the meter, to a power supply. This is precisely the circuit of FIG. 1. The detector circuit 36' of FIG. 2 is now monitoring the potential on the potentiometer 26', which is a function of the current through the meter and through the sensor 22-1. The output of this detector 36' goes by lead 57 to the alarm control 38' and so on. An output also goes by lead 56 to the box 54, which comprises a flip-flop oscillator, or clock, the circuit of which is well known and needs no further description.

So long as the potential on lead 56 is a selected value, the clock 54 puts out on its output leads 58, and 74, a series of square wave pulses, of a selected frequency, such as, for example, 200 cycles per second. This clock signal goes by lead 58 to a counter unit, which includes a units counter 60 and a tens counter 62 and, if desired, a hundreds counter 64. This is conventional equipment. The counters are binary counters, and include decoder units which provide corresponding decimal digital displays, etc.

The lead 74 from the block 54 then goes by the clock bus to terminal 79 which connects to the terminal 79 of FIG. 3 to the clock bus 79, and this bus is connected to each of the flip-flops 86 such that every time a cycle passes from the clock, and the rise portion of the square wave occurs, and is connected to the C terminal of the flip-flops 86, it steps that flip-flop along, putting a high potential on the connecting line 88 from the Q terminal to the J terminal of the succeeding flip-flop, and connecting the Q bar terminal to a low value, and by lead 90 connecting one terminal of that particular sensor into the detecting system of FIG. 2.

So long as the sensor current is below the threshold value, the appropriate voltage will be present on the lead 56 to cause the clock to keep pulsing, and thus to step the counter system one decimal digit for each cycle, and to step the flip-flops 86 sequentially from the first, to the second, to the third, etc. to the (N-1)th and eventually to the Nth flip-flop.

Assuming that there are more than 100 sensors (but not more than 200), the output lead 66 of the tens counter goes to a gate 67 and flip-flop 68 which provides a signal on 69 to display a "1" on the display 64. This "1" displayed on the left of the tens and units display makes the total display read 100 or 100 plus. At the end of each 100 count of the counters, the output of f.f. 68 changes state—either high, or low. At the end of the first 100 count, 69 goes high supplying a "1" on 64. At the end of the second 100 count, 69 goes low, supplying a "0" on 64. Each time 69 goes low (200 count) a negative pulse is supplied to inverter 70 whose output signal is applied to 72 which goes to terminal 80 and then from terminal 80 to the reset bus 80 of FIG. 3. There is a connection from this bus to the R terminal of each of the flip-flops 86, and also to the flip-flop 86N, which connects the sensor 22N to ground in a manner similar to each of the others. The resetting of all the flip-flops 86 starts the sequence again, so that the scanning operation of each of the sensors is repeated, and so on.

An alternative circuit, where 100 or less sensors are used, is applied directly to the input of 70, and 64, 67, 68 and 69 are omitted from the circuit. Then #100 on the display would read "00" and a reset signal would occur every 100 count instead of every 200 count.

If there are fewer than 100 sensors, this same circuit can be provided. Let us say that there are 86 sensors and the switching of the counter units will continue beyond 86 up to 100 and then recycle back to the first one by the reset operation. Of course there will be no connection to a sensor beyond the 86th but then there will be no detected signal and therefore no interruption of the switching of the counter, through 100 and back to 1 .

It is possible also to connect a multi input gate (like 67) to an appropriate group of leads of the counter 62A so, that when the count 86 is reached, the reset signal will be provided and the Nth sensor 22N will be connected and the recycling continued.

It is preferable to leave the control on the 99th count of the tens counter, and that gives some leeway in the addition of subsequent sensors, etc. without really interferring with the operation of the control circuit. Of course, if desired, any sensor, say 22 (N-1) can be disconnected from its flip-flop, without affecting the remainder of the system.

What has been described is a simplified sensor detector and alarm system which can be used with a single detector, plus a scanning circuit, which includes a plurality of sensors, a plurality of switching elements, and a single display unit, so that the single meter, detector, and alarm can be used with the scanning system. The system includes a clock to sequentially connect each of the sensors sequentially to the single detector, and to switch on to the succeeding sensors, etc. at a rate selected by the clock. So long as each of the sensors show a minimum current, below the selected threshold, the switching continues until such a time as one of the sensors shows a threshold or greater current, which the detector then observes. This stops the clock and permits that selected detector to display its current on the meter and to provide a display of the number corresponding to that sensor.

While a particular type of scanning switching circuit has been illustrated, there are other types of switching circuits which can, of course, be used, and this invention is not limited to the particular circuit illustrated, which is shown only for purposes of illustration. Furthermore, other types of alarms can be used including types of oscillators to provide the appropriate alarm signals.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed:

1. A gas and smoke detector system including:

(a) at least one sensor means sensitive to a selected gas or smoke, and adapted to provide a sensor current which is a function of the concentration of said gas or smoke;

(b) power supply means producing a selected d.c. voltage V;

(c) means to apply said voltage V through a first resistor means, through a meter means and through said sensor means to ground;

(d) detector means connected to a point in said first resistor means;

(e) alarm control means responsive to said detector means, to sound an alarm when said detector means detects the flow of a selected minimum current through said first resistor means and said sensor means; and (f) means to subject said sensor means to said gas to be detected and wherein said system includes (g) a plurality of sensor means;

(h) switch means and clock means to control said switch means to sequentially connect each of said plurality of sensor means to said meter means;

(i) said clock means responsive to the magnitude of current through said meter means; and (j) means responsive to a selected magnitude of current through said meter means to disable said switch means for a selected period of time;

whereby said meter can display the value of current flowing through it.

2. The gas detector system as in claim 1, in which said first resistor means comprises potentiometer means, whereby the threshold of said detector means can be varied.

3. The gas detector system as in claim 1 in which said alarm control means includes oscillator means and amplifier means.

4. The system as in claim 1 including counter means responsive to said switch means, said counter means having a count number corresponding to the number of said sensor means which is connected at any selected time, through said meter means and means to display the count number in said counter means when said switch means is disabled.

5. The system as in claim 1 in which said switch means includes flip-flop means.

6. The system as in claim 1 in which said meter means is sequentially placed in series with the first, then the second, then the third sensor, and so on, to the Nth sensor, including means to recycle said switch means back to said first sensor means.

7. The system as in claim 1 in which said sensor means is a solid state sensor means and includes heater means, and means to connect said heater means to said power supply means.

* * * * *